US011559748B2

(12) United States Patent
Koers et al.

(10) Patent No.: US 11,559,748 B2
(45) Date of Patent: Jan. 24, 2023

(54) SYSTEMS AND METHODS FOR PRODUCING VISUAL EFFECTS VIA TRANSDUCER-ACTUATED SHOW ACTION EQUIPMENT

(71) Applicant: Universal City Studios LLC, Universal City, CA (US)

(72) Inventors: Andrew Christopher Koers, Orlando, FL (US); Gary Andrew Brown, Orlando, FL (US); Phillip Ben Burgos, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 17/357,343

(22) Filed: Jun. 24, 2021

(65) Prior Publication Data

US 2022/0032203 A1 Feb. 3, 2022

Related U.S. Application Data

(60) Provisional application No. 63/059,550, filed on Jul. 31, 2020.

(51) Int. Cl.
*A63G 31/02* (2006.01)
*H04R 1/02* (2006.01)

(52) U.S. Cl.
CPC ..... *A63G 31/02* (2013.01); *H04R 1/02* (2013.01)

(58) Field of Classification Search
CPC ..... A63J 1/02; A63J 5/02; A63J 5/04; A63G 31/02; A63G 31/16
USPC ..... 472/60, 61, 130, 134, 136; 463/30; 381/71.7
See application file for complete search history.

(56) References Cited

U.S. PATENT DOCUMENTS 3,567,870 A 3/1971 Rivera et al.
4,204,396 A * 5/1980 Breguet ..... G04C 3/008 968/452
6,659,773 B2 12/2003 Roy et al.
6,738,489 B2 5/2004 Chung et al.
2009/0010468 A1 1/2009 Oser et al.
(Continued)

FOREIGN PATENT DOCUMENTS

IT 201800010505 A1 5/2020
JP 2017131340 A 8/2017

OTHER PUBLICATIONS

Michael Ouellet, Gorilla University: How do Vibration Speakers Work?, Gorilla Gadgets, Aug. 18, 2017, 9 Pages, https://gorillagadgets.com/blogs/gorilla-gadgets-blog/gorilla-university-how-do-vibration-speakers-work.

(Continued)

*Primary Examiner* — Kien T Nguyen
(74) *Attorney, Agent, or Firm* — Fletcher Yoder, P.C

(57) ABSTRACT

A system for providing an actuated-wall visual effect in an amusement park environment, the system comprising a panel mounting frame and a panel coupled to the panel mounting frame via a damper. The system also comprises a transducer mounting frame and a transducer configured to convert an audio signal into mechanical energy. The transducer comprises a first portion coupled to the transducer frame and a second portion coupled to the panel such that the transducer is configured to oscillate the panel relative to the transducer mounting frame in response to receiving the audio signal.

20 Claims, 4 Drawing Sheets

(56) References Cited

U.S. PATENT DOCUMENTS

| | | | | |
|---|---|---|---|---|
| 2010/0150359 | A1* | 6/2010 | KnicKrehm | G06F 30/13 381/71.7 |
| 2020/0129878 | A1 | 4/2020 | Schwartz et al. | |

OTHER PUBLICATIONS

PCT/US2021/041311 International Search Report and Written Opinion dated Nov. 11, 2021.

* cited by examiner

SYSTEMS AND METHODS FOR PRODUCING VISUAL EFFECTS VIA TRANSDUCER-ACTUATED SHOW ACTION EQUIPMENT

CROSS-REFERENCE TO RELATED APPLICATION

This application claims priority to and the benefit of U.S. Provisional Application No. 63/059,550, entitled "SYSTEMS AND METHODS FOR PRODUCING VISUAL EFFECTS VIA TRANSDUCER-ACTUATED SHOW ACTION EQUIPMENT," filed Jul. 31, 2020, which is hereby incorporated by reference in its entirety for all purposes.

FIELD OF DISCLOSURE

The present disclosure relates generally to the field of visual effects in an amusement park. More specifically, embodiments of the present disclosure relate to systems and methods to provide visual effects that are observable by a human.

BACKGROUND

This section is intended to introduce the reader to various aspects of art that may be related to various aspects of the present disclosure, which are described and/or claimed below. This discussion is believed to help provide the reader with background information to facilitate a better understanding of the various aspects of the present disclosure. Accordingly, it is understood that these statements are to be read in this light, and not as admissions of prior art.

Various amusement rides and other attractions have been created to provide passengers with unique motion and visual experiences. For example, amusement ride passengers may experience a plurality of effects during an amusement ride. In addition to excitement induced by a speed or acceleration of an amusement ride occupied by passengers, the passengers may be presented with various special effects (e.g., graphic and/or sound effects). Likewise, other attractions can include visual effects that enhance an experience or provide further immersion in a themed environment, for example. Such effects may in part be brought about by using specialized and costly mechanical equipment, as well as complex control systems. However, it is now recognized that these complex systems and costly equipment often lead to budgetary constraints. Thus, there is a need to provide visual effects that limit expenses.

BRIEF DESCRIPTION

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In an embodiment, a system for providing an actuated-wall visual effect in an amusement park environment includes a panel mounting frame, a panel coupled to the panel mounting frame via a damper, a transducer mounting frame, and a transducer configured to convert an audio signal into mechanical energy. The transducer comprises a first portion coupled to the transducer frame and a second portion coupled to the panel such that the transducer is configured to oscillate the panel relative to the transducer mounting frame in response to receiving the audio signal.

In an embodiment, a system for providing an actuated-wall visual effect in an amusement park environment includes a panel positioned within a room and configured to appear as a structural wall of the room, a transducer mounting frame, and a transducer. The transducer comprises a first portion coupled to the panel and a second portion coupled to the transducer mounting frame. The transducer is also configured to receive an input comprising an audio signal and actuate the panel between a first position and a second position relative to the transducer mounting frame in response to receiving the audio signal.

In an embodiment, a method for providing an actuated-wall visual effect is provided. The method includes receiving an audio signal via a transducer coupled to a panel and configured to actuate the panel based on a frequency of the audio signal and determining, via the transducer, the frequency of the audio signal. The method also includes amplifying an output of the transducer, wherein the output comprises a power output configured to actuate the panel. The method further includes the transducer actuating the panel to a first position relative to at least a portion of the transducer and actuating the panel to a second position relative to the at least a portion of the transducer based on the frequency of the audio signal. Each point of the panel is configured to move to a respective first corresponding location when the transducer actuates the planar surface to the first position. Similarly, each point of the panel is configured to move to a respective second corresponding location on the second planar position when the transducer actuates the panel to the second position relative to the transducer.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1A:
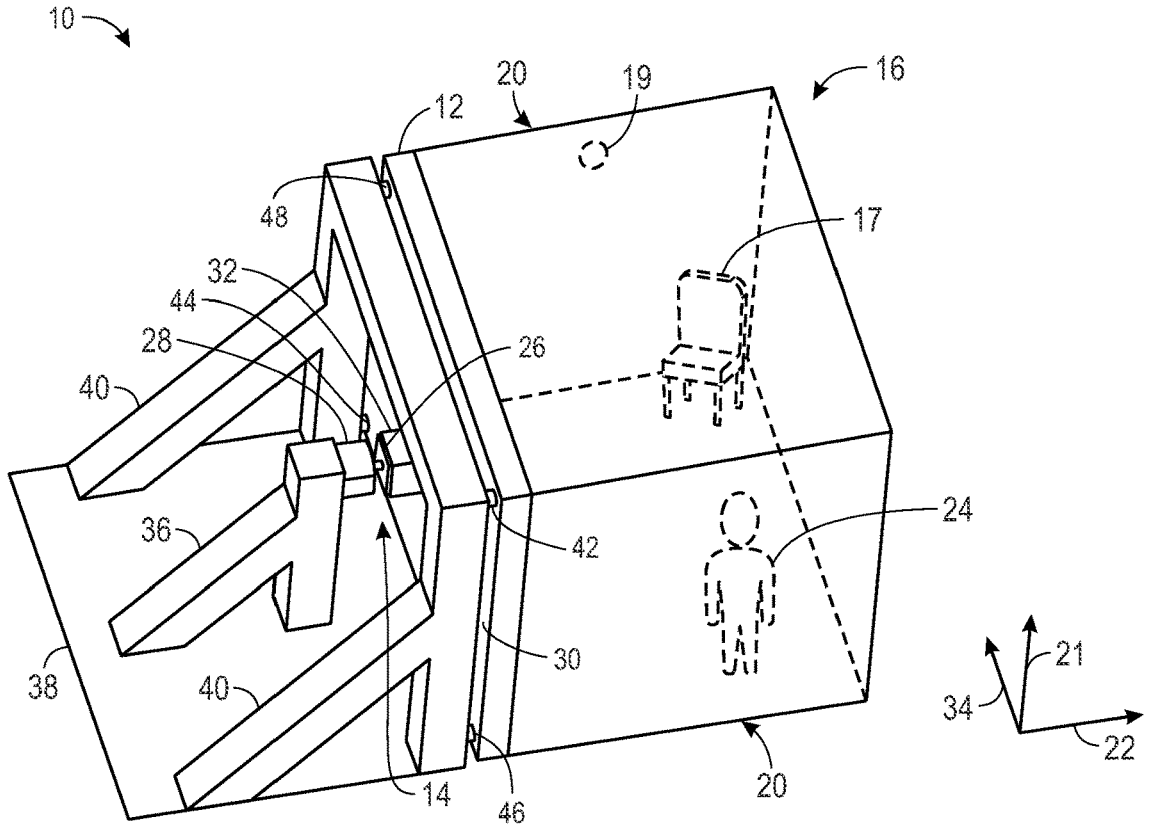
FIG. 1A is a perspective view of an embodiment of a transducer-actuated panel system in which a panel of the transducer-actuated panel system is integrated as a wall in an environment and is in a first position, in accordance with an aspect of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure are directed to systems and methods for producing visual effects via transducer-actuated show equipment. Such systems and methods may be used, for example, as part of an amusement park ride or attraction in an amusement park. Amusement park rides may include passenger vehicle rides in which single-passenger and/or multi-passenger ride vehicles carry passengers along a fixed path. Disposed along the fixed path may be various systems that are configured to cause various visual effects to be observed by one or more passengers of the ride vehicles. In accordance with the present disclosure, a system used to provide observable visual effects includes a transducer-actuated panel system. The transducer-actuated panel system may include a panel or another component of a show action equipment (e.g., a wall) that moves, translates, or oscillates between at least a first position and a second position in response to a transducer of the transducer-actuated panel system receiving an audio signal. In particular, the motion of the panel may be induced, at least in part, by a transducer configured to receive an audio signal and output energy (e.g., work) to the panel. The output of the transducer may cause the panel to oscillate in accordance with a periodic function such as a sine wave. The panel may be coupled to a panel mounting frame that is securely attached to a floor. Specifically, in an embodiment, the panel is coupled to the panel mounting frame via one or more connectors that may include dampers that dampen the motion induced by the transducer and/or passively control the motion of the panel.

By implementing a transducer to actuate (e.g., translate) a panel, cost efficiency and/or financial viability in producing a visual effect may be achieved. Indeed, disclosed herein is a cost-efficient technique to actuate show action equipment without using complex control systems such as hydraulic systems which may cause budgetary constraints to be strained or exceeded for projects that include visual effects. For example, present embodiments may employ an assembly of light weight and porous panel materials with a transducer and supporting structure to provide visual effects with limited costs, which improves efficiency of operation.

The panel or wall may be coupled to a panel mounting frame, which may suspend the panel above ground and avoid contact with other adjacent boundaries (e.g., an adjacent wall). Indeed, the panel may be configured to not touch a floor or other adjacent boundary due to its coupling to the connectors and/or the wall mounting frame. In this way, energy is not dissipated to the floor or other adjacent boundary via the panel and movement of the panel is not hindered. It should be noted however, that, in some embodiments, the panel may include various sliding mechanisms such as wheels or other mechanisms that may reduce an amount of friction incurred in a case in which the panel engages with the floor or other adjacent boundary via the sliding mechanism. For example, the panel may include wheels that contact and slide or roll over the floor.

In some embodiments, the panel may include a porous or nonporous surface and/or a planar or nonplanar surface. Indeed, various types of panels with various types of surfaces (e.g., curve, planar, contoured, rough, smooth) may be coupled to the transducer, and as such, may be actuated by the transducer. Further, the panel may include features that cause it to blend in with a surrounding theme. For example, the panel may include framed pictures hung thereon or a suit of armor. Such features may be made of light and porous material such that they give the appearance of solid material but remain light and capable of passing air therethrough to reduce an amount air resistance incurred when the panel is actuated.

The transducer may be coupled to a transducer mounting frame that is non-moveably coupled to a floor. A first portion of the transducer may be non-movably coupled to the panel via a connector and a second portion of the transducer may be non-movably coupled to the transducer mounting frame, which is non-moveably coupled to the floor. In this way, the first portion of the transducer may be configured to oscillate the panel along one or more axes. Likewise, the first portion may oscillate at a similar frequency as the panel.

The movement of the panel may be directed along (e.g., parallel to) a line of sight of a particular passenger in a ride vehicle, directed along a direction perpendicular to the line of sight of the particular passenger, or a combination thereof. In an embodiment, the panel may be integrated as a full wall in an environment. In such an embodiment, the panel may produce a visual effect of a "breathing" wall when it is actuated by the transducer. In another embodiment, the panel is integrated as a section of a wall in an environment. A similar visual effect may be produced in this embodiment. In other embodiments, different motions may cause different effects (e.g., disorientation of an observer), which may be emphasized by surrounding features (e.g., props) and lighting.

By way of introduction, FIG. 1A is a perspective view of a transducer-actuated panel system 10 including a panel 12 and a transducer 14 that are integrated into an environment 16. The environment 16 may include a portion of an amusement ride or other attraction in an amusement park. The environment 16 may also include a room (e.g., a space, a theater) having one or more walls (e.g., barriers, fences). The environment 16 may also include various props 17 and lighting 19 (e.g., projections, laser lights) that can be used to supplement effects provided by the transducer-actuated panel system 10. In the illustrated embodiment, the environment 16 includes boundaries defined by the panel 12 and walls 20 fixedly positioned adjacent to the panel 12. The panel 12 has a height oriented parallel to the axis 21, a width oriented parallel to the axis 34, and a thickness oriented parallel to the axis 22. An observer 24 and an example prop 17 are shown within the environment 16 and are depicted in dashed lines as they are being observed through the walls 20 of the environment 16.

Figure 1B:
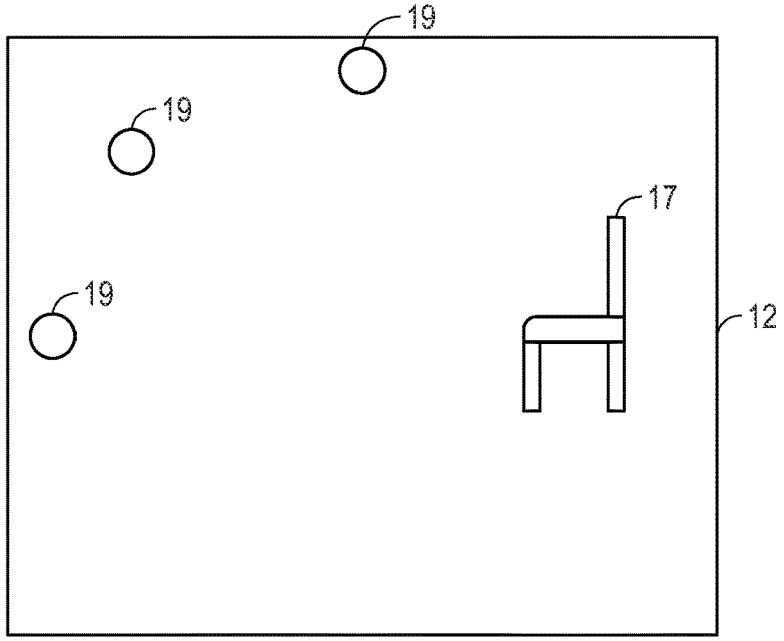
FIG. 1B is a front-faced view of the panel of the transducer-actuated panel system of FIG. 1A.

FIG. 1B is a front view of the panel 12. The panel 12 includes a prop 17 and lighting 19 (e.g., light emitters) disposed in various positions on a surface of the panel 12 that faces away from the transducer. The props 17 and the lighting 19 may be configured to amplify an effect of the transducer-actuated panel system 10 when the panel 12 is in motion. It should be noted that the prop 17 illustrated in FIG. 1B is not the same as the prop 17 illustrated in FIG. 1A. While both props 17 may emphasize movement of the panel 12 (e.g., by projecting different shadows based on movement of the panel 12), the prop 17 in FIG. 1A is separate from the panel 12 and the prop 17 in FIG. 1B is coupled to the panel 12. The surface of the panel 12 may have an appearance similar to one or more of the adjacent walls 20 relative to an observer 24 in the environment 16. Further, the surface of the panel 12 may be porous or nonporous and planar or nonplanar (e.g., curved, flat). However, as opposed to a stationary wall or panel, the panel 12 is configured to produce, via actuation, a visual and kinetic effect via actuation observable by the observer 24. It should be noted that geometric terms, such as parallel, are used herein to describe physical relationships of components. However, such terms should not be interpreted in a strict mathematical sense. For example, a feature described as being parallel to another feature does not require perfect parallel alignment. Rather, such terminology should be understood as providing a general description of orientation within tolerances, as would be understood by one assembling structures in accordance with present embodiments.

The visual and kinetic effect may include a visual effect of a moving or "breathing" wall or panel. Indeed, the panel 12 is configured to oscillate or translate between at least two positions or configurations. Returning back to FIG. 1A, the panel 12 is in a first position and the transducer 14 is in a first transducer configuration. The panel 12 may be configured to oscillate parallel to the axis 22, the axis 34, the axis 21, or a combination thereof. In an embodiment including movement along the axis 22, the panel 12 may be observed by the observer 24 as moving toward and away from the observer 24, who may be located in a ride vehicle, for example. Specifically, for example, the panel 12 may be translated back and forth parallel to the axis 22, via the transducer 14 of the transducer-actuated panel system 10. The speed of translation may be slow to provide a breathing effect, wherein the panel 12 appears to be slowly inhaling and exhaling. In other embodiments, more rapid movements may be employed to create a more intense visual effect. Indeed, the panel 12 may be moved or actuated by the transducer 14 in various different directions and at various different speeds.

The transducer 14 is configured to output work to the panel 12 in response to receiving one or more audio signals. In particular, the transducer 14 is configured to receive audio signals and output specific outputs corresponding to the audio signals. One of the outputs of the transducer 14 is energy configured to actuate the panel 12 in accordance with one or more frequencies of the audio signals. As such, the transducer 14 may receive the audio signals and actuate the panel 12 in accordance with a periodic function such as a sinusoidal wave function having a frequency corresponding to the frequency of the audio signals. Accordingly, in the illustrated embodiment, the panel 12 may translate along directions parallel and anti-parallel to the axis 22 at one or more frequencies corresponding the one or more frequencies of received audio signals. In response to an actuation of the panel 12 by the transducer 14, the observer 24 may be able to observe movement of the panel 12. Such movements may be exaggerated or enhanced by the placement and/or movement of the props 17 and the use of lighting systems (e.g., the lighting 19), in accordance with present embodiments. For example, the lighting 19 and the props 17 may provide context or even emphasize the impact of movement of the panel 12. In a specific example, the lighting 19 may include features (e.g., lamp housings as flame effects) present on the panel 12 and shadows cast by the corresponding light may emphasize the movement of the panel 12.

In the illustrated embodiment, the transducer 14 is positioned on a rear side 30 of the panel 12 such that the observer 24 may be blocked from or have relative difficulty in observing the transducer 14 from a location within the environment 16. The transducer 14 comprises a first portion 26 and a second portion 28. Either of the first portion 26 and the second portion 28 may include an actuated structure (a part that is moved) or an actuation mechanism (a part that initiates movement). The first portion 26 (e.g., an actuated coupler) of the transducer 14 is coupled to the panel 12 via a fastener 32 (e.g., an adhesive or a bolt) that lies or extends between the first portion 26 and the panel 12. The first portion 26 (e.g., a base support and activator) is non-moveably coupled to the fastener 32. In some embodiments, the fastener 32 may include one or more screws that couples the first portion 26 to the panel 12. In the illustrated embodiment, the first portion 26 and the fastener 32 are located proximate to a midpoint of the panel 12 on the rear side 30 of the panel 12. The midpoint of the panel 12 may refer to a calculated or estimated center point (based on mass or geometry) on the rear side 30 of the panel 12. It is to be understood, however, that in different embodiments, the fastener 32 and/or first portion 26 of the transducer 14 may be located and/or coupled to other positions on the panel 12. Also, in some embodiments, additional transducers and/or portions thereof may be coupled to the panel 12 (e.g., via one or more fasteners) resulting in unidimensional (e.g., motion along the axis 22) or multidimensional motion (e.g., motion along the axis 22 and along the axis 34).

In the depicted embodiment, the second portion 28 of the transducer 14 is non-moveably coupled to a transducer mounting frame 36. The transducer mounting frame 36 is non-moveably coupled to a floor 38, which lies parallel to the axis 22 and the axis 34. The transducer mounting frame 36 is stationary relative to the floor 38. In other words, no significant movement may occur between the transducer mounting frame 36 and the floor 38. In some embodiments, the transducer mounting frame 36 may be coupled with (e.g., screwed into) the floor 38 such that no movement occurs between the floor 38 and the transducer mounting frame 36 along the axis 22.

In the illustrated embodiment, the panel 12 is moveably coupled to a panel mounting frame 40 via connectors 42, 44, 46, 48, which are located proximate to a corner or edge (e.g., an extremity) of the surface of the panel 12. The connectors 42, 44, 46, 48 comprise dampers (e.g., suspension-type dampers, which may include a damped spring) attached at the respective position on the rear side 30 of the panel 12. The dampers may be utilized to dampen, stabilize, and/or smoothen the motion of the panel 12 in response to an actuation of the panel 12 by the transducer 14. As such, the dampers may be tuned to cause the panel to oscillate at a certain frequency, which may be based on a frequency of the audio signal(s). For example, the dampers may dampen oscillatory movement that may occur based upon an actuation induced by the transducer 14. The dampers may also be configured to limit transfer of mechanical energy between the panel 12 and the transducer 14. In some embodiments, the connectors 42, 44, 46, 48 may be located in various other locations on the panel 12 than in the illustrated embodiment. Also, in some embodiments, the panel 12 may be suspended above the floor 38, and as such, may not be configured to dissipate energy (e.g., friction) on the floor 38 during its movement. Further, in some embodiments, the panel 12 may be flexible and the connectors 42, 44, 46, 48 or the like may cooperate with the transducer 14 to cause distortion of the panel 12, such as a rippling effect or presentation of an undulating topology. Also, in some embodiments, the panel 12 may be nested or recessed into the panel mounting frame, such that at least a portion of the panel 12 is aligned with the at least a portion of the panel mounting frame. Further, in some embodiments, the environment may include multiple panels coupled to one or more transducers such that that the environment expands and contracts in multiple dimensions.

Figure 2:
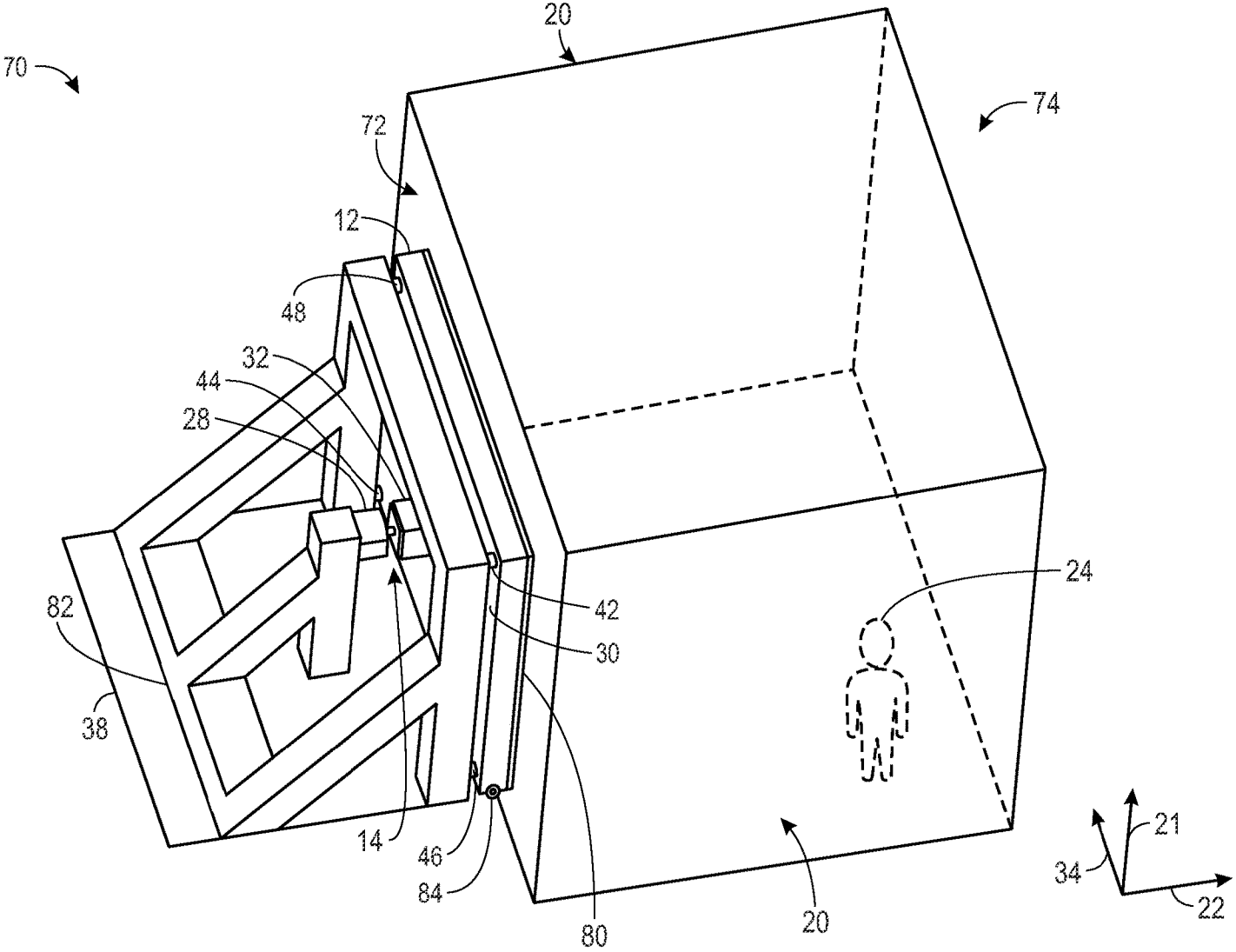
FIG. 2 is perspective view of an embodiment of a transducer-actuated panel system in which a panel of the transducer-actuated panel system is integrated in an environment as a portion of a wall and is in a first position, in accordance with an aspect of the present disclosure.

FIG. 2 is an embodiment of a transducer-actuated panel system 70 integrated into a particular wall 72 of an environment 74, which may include various props and lighting similar to the prop 17 and the lighting 19 of the environment 16 of FIG. 1A. In the depicted embodiment, the panel 12 lies in a first position and is aligned and adjacent to the wall 72, which is fixedly positioned adjacent to the panel 12 such that the transducer 14 is configured to oscillate the panel 12 relative to the wall 72. In the illustrated embodiment, the panel 12 is configured to oscillate or translate along the axis 22 at a frequency observable by the observer 24 via the transducer 14. The motion of the panel 12 may be observed relative to the wall 72. For example, a surface of the panel 12 and a surface of the wall 72 in the environment may be facing in a direction parallel the axis 22. When the panel 12 translates parallel to the axis 22, movement and or changes in alignment of the surfaces may be observed especially near the edges or corners adjacent to the wall 72 and the panel 12. Further, in the illustrated embodiment, located nigh of the edges of the adjacent portions of the panel 12 and the wall 72 is a flexible material 80. The flexible material 80 is configured to extend between a gap formed between the panel 12 and the wall 72. For example, when the panel 12 and wall 72 are misaligned (e.g., when the panel 12 is not in the first position), the flexible material 80 may extend in the gap existing between the misaligned panel 12 and wall 72. This may improve immersion and avoid drawing attention to a separation between the panel 12 and adjacent features. In embodiments where the panel 12 corresponds to an entire wall, such as the panel 12 integrated into the environment 16 of FIG. 1A, similar flexible material 80 may be employed to hide gaps as well.

As mentioned above, in the illustrated embodiment, the panel 12 is in the first position. In the first position, the panel 12 is aligned with the wall 72. Similarly, transducer 14 is in a first transducer configuration. In the first position and in the first transducer configuration, the panel 12 and the wall 72 may appear to be a unified barrier from the view of the observer 24. The first position of the panel 12 and/or the first transducer configuration may correspond to an inactive (e.g., deactivated) configuration of the transducer 14 and/or a state in which the panel 12 has a maximum amount of kinetic energy in an oscillation or another type of periodic cycle. It should be noted however, that, in some embodiments, the transducer's inactive configuration may correspond to a position of the panel 12 in which a surface of the panel 12 is misaligned with the surface of the wall 72. Indeed, in these embodiments, the transducer's inactive configuration may correspond to a position in which the panel 12 is rearward of the wall 72 or forward of the wall 72.

In the illustrated embodiment, a frame 82 (e.g., a common frame) comprises a first section that mounts the transducer 14 and a second section that mounts the panel 12. The frame 82 may be mounted to the floor 38 via one or more fasteners (not shown). It should be noted that the frame 82 may also be implemented in the environment 16 illustrated in FIG. 1A. Similarly, the transducer mounting frame 36 and the panel mounting frame 40 illustrated in FIG. 1A may be implemented in an embodiment in which the panel 12 is integrated in an environment as a portion or segment of a wall, rather than as a full wall.

In the illustrated embodiment, a sliding or rolling mechanism (e.g., the wheel 84) is coupled to the panel 12 to allow the panel 12 to roll across the floor 38. Sliding or rolling mechanisms may be included to allow for smooth transitions between positions of the panel 12. The rolling mechanisms and the sliding mechanism may include wheels and linear bearings, though other suitable mechanisms may be used. These rolling and sliding mechanisms may support the weight and/or orientation of the panel 12 and may cause the panel 12 to roll or slide across the floor 38. Similarly, sliding and/or rolling mechanisms may be attached on other edges of the panel 12, such as to edges adjacent to one or more wall (e.g., the adjacent walls in FIGS. 1A and 2). These rolling and/or sliding mechanisms may reduce friction between the floor 38 and/or other stationary structures.

Figure 3:
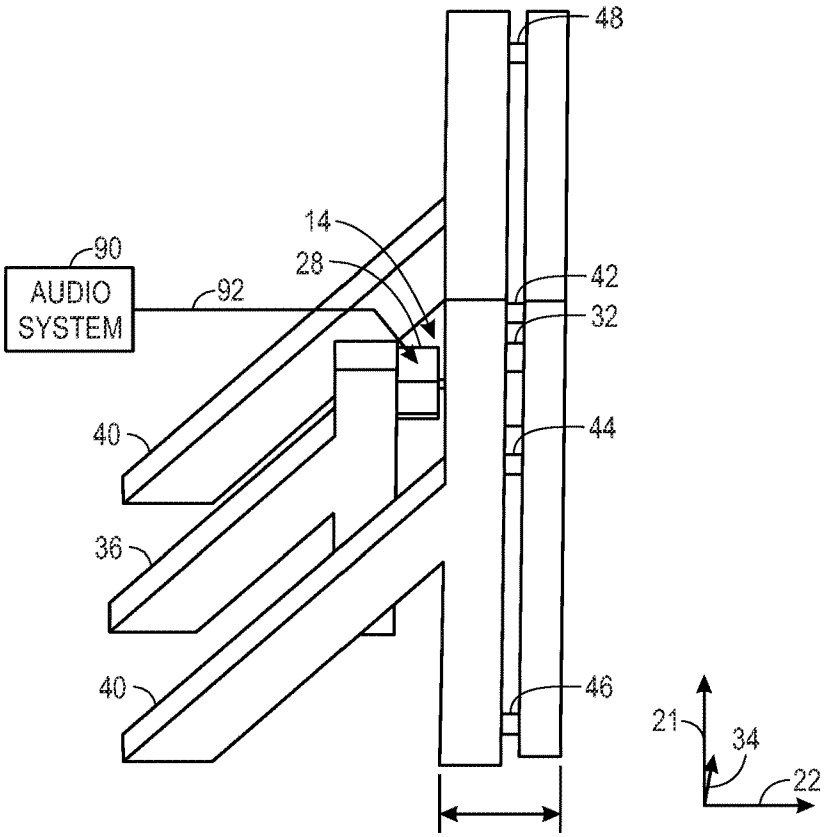
FIG. 3 is a view of the embodiment of the transducer-actuated panel system of FIG. 1A in which the panel is in a second position.

FIG. 3 illustrates an example of the transducer-actuated panel system 10 when the panel 12 is in a second position (e.g., a forward position) and the transducer 14 is in a second transducer configuration. The connectors 42, 44, 46, 48 (e.g., dampers, suspension-type dampers) are likewise in an extended configuration (e.g., forward position, second position). In some embodiments, the second position may correspond to a maximum extended position of the panel 12 and/or connectors 42, 44, 46, 48 away from the transducer mounting frame 36 and/or panel mounting frame 40. Also, in the second position, the connectors 42, 44, 46, 48 may, in some embodiments, contain potential energy to be released when the transducer 14 actuates the panel 12 in a direction anti-parallel to the axis 22 (e.g., towards the transducer mounting frame 36). The transducer mounting frame 36 and the panel mounting frame 40 may remain non-moveably coupled to the floor 38 when the panel 12 is in the second position.

The panel 12 may have translated to the second position in response to an actuation from the transducer 14. For example, the transducer 14, in response to receiving, via medium 92, one or more audio signals characterized by one or more frequencies from the audio system 90, may have actuated the panel 12 from the first position illustrated in FIG. 2 to the second position (e.g., a forward position) in a direction parallel to the axis 22. The same audio signals may be used with the audio system 90 such that the panel 12 is actuated in coordination with audio (e.g., sounds of a heart beating).

When the panel 12 is being actuated by the transducer 14 to the second position, an observer may observe the panel translating toward herself along the axis 22. In other words, if the observer is observing the panel 12 a direction anti-parallel to the axis 22, the panel 12 may appear to be closer to the observer than when the panel 12 was in the first position. Also, the translation of the panel along the axis 22 may be a translation relative to an inactive configuration of the transducer 14, which as noted previously, may correspond to a position in which the panel 12 is aligned with a wall such as the wall 72 of FIG. 2.

Figure 4:
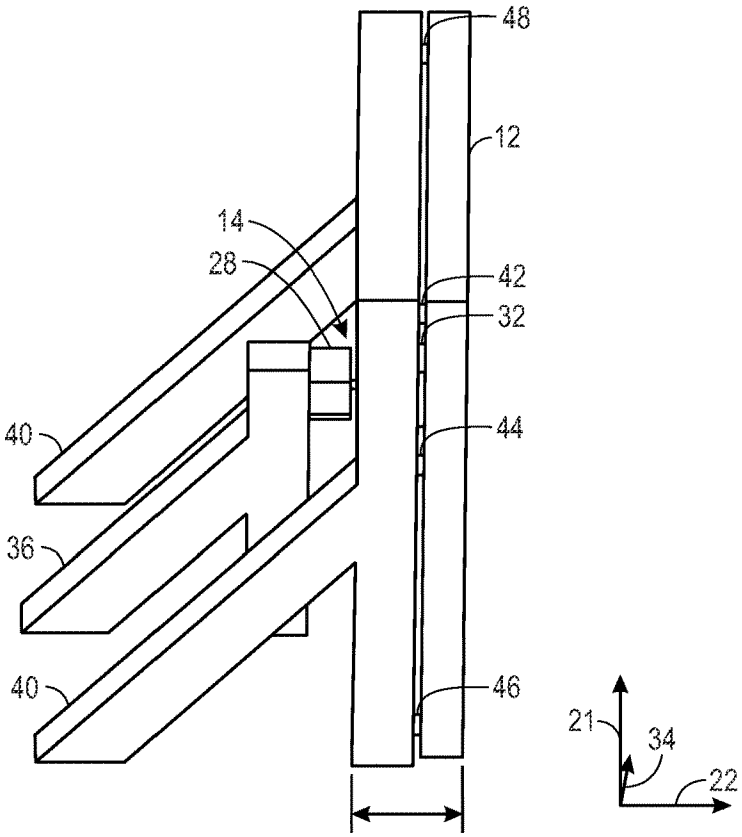
FIG. 4 is a view of the embodiment of the transducer-actuated panel system of FIG. 1A in which the panel is in a third position.

FIG. 4 illustrates an example of the transducer-actuated panel system 10 when the panel 12 is in a third position (e.g., a rearward position) and the transducer 14 is in a third transducer configuration. The connectors 42, 44, 46, 48 are likewise in a contracted configuration. For example, damped springs in the connectors 42, 44, 46, 48 may be contracted. The transducer 14, in response to receiving one or more audio signals characterized by one or more frequencies, may actuate the panel 12 from the first position illustrated in FIGS. 1 and 2 or from the second position illustrated in FIG.

3 to the third position (e.g., a rearward position). In some embodiments, the third position may correspond to a maximum contracted position of the panel 12 and/or connectors 42, 44, 46, 48 are actuated towards the transducer mounting frame 36 and/or panel mounting frame 40. Further, in some embodiments, in this configuration, the connectors 42, 44, 46, 48 may have a maximum amount of stored potential energy. The transducer 14 may oscillate the panel 12 between the second position depicted in FIG. 3 and the third position depicted in FIG. 4 at a frequency corresponding to an audio signal received by the transducer 14. For instance, when a waveform of the audio signal received approximates or equates to a sinusoidal wave, the resulting output of the transducer may be a sinusoidal oscillation of the panel at a frequency corresponding the sinusoidal wave of the audio signal. For example, if the received audio signal may be characterized by a periodic function such as a sine wave with a frequency of 6 Hz, then the transducer may oscillate the panel at a frequency at or near 6 Hz. As such, in this example, the total time it takes for the panel to translate from the second position to the third position and back to the second position may be equal to or near $1/6^{th}$ of a second.

Keeping in mind that the panel 12 may be integrated as a wall in an environment such as the environment 16 of FIG. 1A, when the panel 12 is in the third position (e.g., the rearward position), the environment 16 of FIG. 1A may have an extended dimension (e.g. extended length along the axis 22), and as such, the room may appear to be enlarged because the panel 12 has been moved away from the wall 20 of FIG. 1A. Similarly, in the environment 74 of FIG. 2, the panel 12 may translate or initiate an oscillation from a position that is aligned or misaligned with the wall 72 of FIG. 2 (e.g., extended in the rearward direction of the wall 72 or extended in the forward direction of the wall 72). It should be noted that a rest position of the panel may correspond to a position in which the transducer is in a deactivated configuration (e.g., the first transducer configuration).

Furthermore, it should be noted that the motion of the panel 12 may be distinguished from a vibration of the panel 12. Specifically, the motion of the panel 12 induced by the transducer 14 may produce motion visually observable by an observer such as the observer 24 of FIGS. 1 and 2. The visual effect may include a panel or wall that appears to be "breathing", oscillating at a frequency observable by a human eye. Moreover, the panel 12, in operation, may not be configured to be touched by a human. The transducer 14 may be configured to oscillate the panel 12 at an oscillation frequency between 1 and 10 Hz. The transducer 14 may likewise oscillate the panel 12 at other frequencies outside of the frequency range between 1 and 10 Hz. The oscillatory motion of the panel 12 may be configured to prevent or limit production of sound audible to a human ear such as that of the observer 24. As such, in some embodiments, the panel 12 may have a porous surface to reduce an amount of air that is moved as a result of the oscillation of the panel 12. The transducer 14 may be configured to oscillate the panel 12 such that a total distance the panel 12 traverses in oscillation cycle is between 0.5 centimeters and 5 centimeters. In other embodiments, the panel 12 may traverse a total distance outside of the above-listed range.

Figure 5:
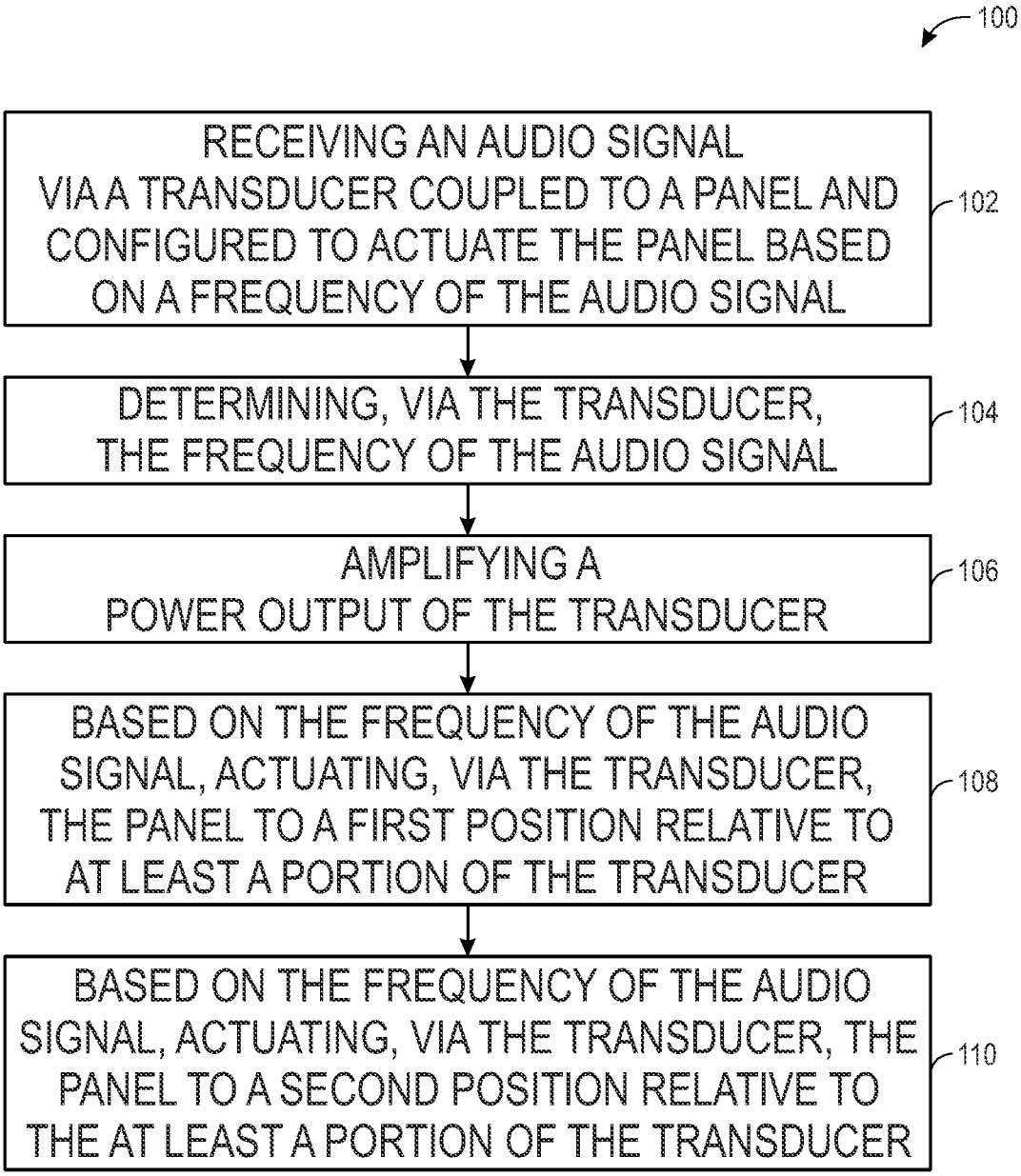
FIG. 5 is an embodiment of a method for providing an actuated-wall effect, in accordance with an aspect of the present disclosure.

FIG. 5 illustrates a method 100 for providing an actuated-wall effect. The method 100 may be performed by at least a transducer such as the transducer 14 and/or by a controller system of the transducer. For example, at least an active transducer (e.g., a self-generating transducer) and/or at least a passive transducer (e.g., an externally powered transducer) may be utilized in the performance of the method 100. The method 100 may be performed in the order illustrated in FIG. 5 and detailed below. The method 100 may also be performed in another suitable order than the order depicted in FIG. 5. Also, one or more steps of the method 100 may be excluded in an embodiment of the method 100.

In the depicted embodiment, the method 100 begins with receiving (block 102) an audio signal via a transducer coupled to a panel and configured to actuate the panel based on a frequency of the audio signal. The transducer may be communicatively coupled to an output of an audio system configured to send audio signals to the transducer and controlled by a dial or knob configured to control a frequency of audio signals output from the audio system. In some embodiments, the audio signal received may be based on or the same audio signal that is provided to an audio system and this may facilitate coordination of panel movements with music or sound effects.

The method 100 continues with determining (block 104), via the transducer, the frequency of the audio signal. In response to determining the audio signal, the transducer may be configured to generate a surge of energy configured to amplify (block 106) an output of the transducer. A power output of the transducer may be amplified to allow for an actuation of the panel. For example, block 106 may include receiving the surge of energy configured to amplify the power output of the transducer from an electrical outlet or other electrical source e.g., a generator to move the panel. For example, the transducer may increase an amount of power it receives from the generator to actuate the panel in response to determining the frequency of the audio signal The method 100 includes actuating (block 108), via the transducer, the panel to a first position relative to at least a portion of the transducer based on the determined frequency of the audio signal. It should be noted that the actuation of the panel to the first position may be an actuation or translation relative to a transducer mounting frame non-moveably coupled to the at least a portion of the transducer. Each point of the panel may be configured to move to a respective first corresponding position or location. In other words, each point of the panel may be actuated to traverse one or more distances in one or more directions corresponding to the actuation of the panel to the first position. Each of the one or more distances may be generally similar or different in amounts. In some embodiments, the respective first corresponding location is a location on a first hypothetical planar surface. In these embodiments, each point of the panel may be actuated to the respective first corresponding location, wherein each of the respective first corresponding locations are located on the first hypothetical planar surface. The first hypothetical planar surface may correspond to a hypothetical plane perpendicular (e.g., normal) to a direction of actuation of the panel.

The method continues with actuating (block 110), via the transducer, the panel to a second position relative to the at least a portion of the transducer based on the determined frequency of the audio signal. It should be noted that the actuation of the panel to the second position may be an actuation or translation relative to a transducer mounting frame non-moveably coupled to at least a portion of the transducer. Each point of the panel may be configured to move to a respective second corresponding position or location. In some embodiments, the respective second corresponding location is a location on a second hypothetical planar surface. In these embodiments, each point of the panel may be actuated to the respective second corresponding position. The second hypothetical planar surface may correspond to a hypothetical plane perpendicular to the direction of actuation of the panel. It should be noted that the respective first corresponding position and the respective second corresponding position correspond to different positions relative to at least a portion of the transducer.

One or more steps of the method 100 may be repeated, and as such, the panel may oscillate in accordance with a periodic function such as that of a sinusoidal function. Indeed, the transducer may cause the panel to oscillate at a frequency corresponding to the audio signals it receives. In an embodiment, the transducer may receive audio signal of different characteristics and as such, dynamically change the frequency of oscillation of the panel.

Although in actuality, a mathematical true planar surface is an abstract idea, it should be noted that "planar surface", "hypothetical planar surface," and other variances of planar surfaces used herein is meant to refer to a relatively planar surface. For example, in the method 100, the panel may comprise a planar surface. Each point of the planar surface may be actuated, via the transducer, by an amount generally corresponding to a distance given by a difference or gap between the first hypothetical planar surface and the second hypothetical planar surface in response to the transducer receiving the audio signal. Further, when referring to each point of the planar surface moving to a respective corresponding location on the first hypothetical planar surface or second hypothetical planar surface, it is to be understood that each point may not necessarily lie directly upon the respective corresponding location on the first hypothetical planar surface or second hypothetical planar surface. What is meant to be inferred is that the actuation induced by the transducer is utilized to produce a visual effect rather than a vibratory affect, which may not be visible to a human observer. Indeed, although the transducer may induce some vibration relative to the panel, the translation of the panel from a position to the second position illustrated in FIG. 3, the third position illustrated in FIG. 4, and/or another position, may be observed by an observer (such as the observer 24 of FIGS. 1A and 2).

Present embodiments facilitate provision of visual effects that are cost efficient and easily coordinated with other effects. For example, present embodiments utilize transducers to actuate a panel or wall in a manner that makes it appear as though an actual supportive wall of a room is moving (e.g., providing a breathing effect for the room). In some embodiments, this is facilitated by using light weight and porous material to form the panel and simulate the actual wall, wherein the panel is coupled to the transducer. The effects produced by moving the panel with the transducer can be amplified by lighting or props. For example, lighting attached to the moving panel may cast shadows during the course of movement that emphasize the fact that the panel is moving relative to other features or props in the room. Another benefit of present embodiments is that the transducer is controlled by an audio signal. Thus, present embodiments may be controlled based on or by utilizing a signal that provides audio for an attraction, which is also utilizing present embodiments for visual effects. Thus, the visual effects may readily coordinate with the audio being provided by the audio system. As an example, a breathing sound may be generated by the audio system. Additionally, in coordination with the breathing sound, which may be audible to an observer in the room, a corresponding signal, which may be inaudible to the observer in the room, may be generated and transmitted to the transducer, and as such, the corresponding signal may control actuation of the panel such that panel moves in coordination with the breathing sound and makes the room appear to be breathing.

While embodiments of the present disclosure are generally discussed in the context of an amusement park, it should be understood that the techniques for producing visual effects using transducer-actuated panels disclosed herein may be used in other contexts. For example, the present techniques may be used in conjunction with non-vehicle based attractions or shows located outside of amusement parks such as in a theatre. Further, it should be understood that certain elements of the disclosed embodiments may be combined or exchanged with one another. Further, it should be noted that one or more aspects of a particular transducer-actuated panel system embodiment described may be combined with other aspects of another transducer-actuated panel system embodiment described herein.

While only certain features of the present disclosure have been illustrated and described herein, many modifications and changes will occur to those skilled in the art. It is, therefore, to be understood that the appended claims are intended to cover all such modifications and changes that fall within the true spirit of the present disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system for providing an actuated-wall visual effect in an amusement park environment, the system comprising:

a panel mounting frame;

a panel coupled to the panel mounting frame via a damper;

a transducer mounting frame; and a transducer configured to convert an audio signal into mechanical energy, the transducer comprising a first portion coupled to the transducer mounting frame and a second portion coupled to the panel such that the transducer is configured to oscillate the panel relative to the transducer mounting frame in response to receiving the audio signal.

2. The system of claim 1, wherein the panel is arranged within a room to appear as though it is a structural wall of the room.

3. The system of claim 1, wherein the panel is coupled to the panel mounting frame via a plurality of dampers including at least one suspension-type damper.

4. The system of claim 1, wherein the panel is arranged within a room and the panel mounting frame is mounted to a floor of the room.

5. The system of claim 1, wherein the second portion of the transducer is coupled to the panel proximate to a midpoint of the panel.

6. The system of claim 1, wherein the transducer is configured to oscillate the panel in a sinusoidal oscillation.

7. The system of claim 1, wherein the transducer is configured to oscillate the panel such that a total distance the panel traverses along an axis in one oscillation cycle is between 0.5 centimeters and 5 centimeters.

8. The system of claim 1, comprising a light emitter coupled to the panel on a surface facing away from the transducer.

9. The system of claim 1, wherein the panel includes porous material and wherein the system is configured such that oscillation of the panel does not produce sound audible to a human ear.

10. The system of claim 1, wherein the transducer is configured to oscillate the panel at an oscillation frequency between 1-10 Hz.

11. The system of claim 1, wherein the panel mounting frame and the transducer mounting frame are components of a common frame.

12. The system of claim 1, wherein the panel comprises a plurality of corners and each corner of the plurality of corners is coupled to the panel mounting frame via a respective damper configured to limit transfer of mechanical energy between the panel and the transducer.

13. The system of claim 1, comprising a wall fixedly positioned adjacent the panel such that the transducer is configured to oscillate the panel relative to the wall.

14. The system of claim 13, wherein the panel is aligned with the wall when the transducer is deactivated such that the panel and the wall appear to be a unified barrier.

15. The system of claim 13, comprising a flexible material extending between a gap formed between the panel and the wall.

16. The system of claim 13, wherein the transducer is configured to oscillate the panel such that the panel moves back and forth along an axis normal to a surface of the wall.

17. A system for providing an actuated-wall visual effect in an amusement park environment, the system comprising:

a panel positioned within a room and configured to appear as a structural wall of the room;

a transducer mounting frame; and a transducer comprising a first portion coupled to the panel and a second portion coupled to the transducer mounting frame, the transducer configured to:

receive an input comprising an audio signal; and actuate the panel between a first position and a second position relative to the transducer mounting frame in response to receiving the audio signal.

18. The system of claim 17, wherein the audio signal is characterized by a frequency inaudible to a human ear.

19. The system of claim 17, comprising the structural wall of the room, wherein the panel is positioned adjacent the structural wall and is formed of a porous material that appears like a surface of the structural wall.

20. A method for providing an actuated-wall effect, the method comprising:

receiving an audio signal via a transducer coupled to a panel and configured to actuate the panel based on a frequency of the audio signal;

determining, via the transducer, the frequency of the audio signal;

amplifying a power output of the transducer; and based on the frequency of the audio signal:

actuating, via the transducer, the panel to a first position relative to at least a portion of the transducer; and actuating, via the transducer, the panel to a second position relative to the at least a portion of the transducer.

* * * * *